US007915835B2

(12) United States Patent
Takenaka

(10) Patent No.: US 7,915,835 B2
(45) Date of Patent: Mar. 29, 2011

(54) IMAGING APPARATUS, STROBE DEVICE, AND CHARGING-CONTROL METHOD

(75) Inventor: Takuya Takenaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 491 days.

(21) Appl. No.: 12/060,495

(22) Filed: Apr. 1, 2008

(65) Prior Publication Data

US 2008/0252230 A1 Oct. 16, 2008

(30) Foreign Application Priority Data

Apr. 10, 2007 (JP) ..... P2007-102319

(51) Int. Cl.
*H05B 37/00* (2006.01)

(52) U.S. Cl. ..... 315/241 P; 315/241 S; 315/219; 315/241 R; 315/224; 315/307; 320/140; 320/149; 320/166

(58) Field of Classification Search ..... 315/241 P, 315/241 S, 241 R, 200 A, 19, 224, 225, 239, 315/247, 307; 363/18, 21.12, 126; 396/203, 396/205; 320/137, 140, 149, 166, DIG. 28
See application file for complete search history.

(56) References Cited

U.S. PATENT DOCUMENTS

| | | | | |
|---|---|---|---|---|
| 3,917,975 | A * | 11/1975 | Birkner | 315/200 R |
| 4,295,717 | A * | 10/1981 | Kitagawa | 396/203 |
| 5,780,976 | A * | 7/1998 | Matsuo | 315/241 P |
| 6,291,974 | B1 * | 9/2001 | Matsuo | 320/166 |
| 6,892,029 | B2 * | 5/2005 | Tsuchida et al. | 396/200 |

FOREIGN PATENT DOCUMENTS

| | | |
|---|---|---|
| JP | 2000-275706 | 10/2000 |
| JP | 2007-48702 | 2/2007 |

* cited by examiner

*Primary Examiner* — Haissa Philogene
(74) *Attorney, Agent, or Firm* — Oblon, Spivak, McClelland, Maier & Neustadt, L.L.P.

(57) ABSTRACT

An imaging apparatus including a strobe device having a charging circuit of a separately excited oscillation type is provided. The apparatus includes a main capacitor in which charge is accumulated to supply power to a strobe-light-flashing unit, a step-up transformer including at least primary and secondary coils, a switching element that performs a switching operation to control a current supplied to the primary coil, a rectifier diode that rectifies a flyback pulse generated in the secondary coil to supply a charging voltage to the main capacitor, a power-supply-interrupting circuit that selectively interrupts power supplied from the power supply, a full-charge detection unit that detects whether the main capacitor reaches a fully charged state, and a power-supply-control unit that controls the power-supply-interrupting circuit so as to set the power-supply-interrupting circuit to be in an interrupting state.

7 Claims, 9 Drawing Sheets

Prior Art

IMAGING APPARATUS, STROBE DEVICE, AND CHARGING-CONTROL METHOD

CROSS REFERENCES TO RELATED APPLICATIONS

The present invention contains subject matter related to Japanese Patent Application JP 2007-102319 filed in the Japanese Patent Office on Apr. 10, 2007, the entire contents of which are incorporated herein by reference.

BACKGROUND OF THE INVENTION

1. Field of the Invention

The present invention relates to an imaging apparatus including a strobe device, a strobe device, and a charging-control method for the strobe device. More particularly, the present invention relates to an imaging apparatus including a strobe device having a charging circuit of a separately excited oscillation type, a strobe device, and a charging-control method.

2. Description of the Related Art

In recent years, there have been various types of strobe-charging circuits used for strobe devices or the like. Charging circuits that have been used often lately are of a separately excited oscillation type, and more specifically, of a flyback transformer type. FIG. 9 is a diagram of a configuration example of a strobe-charging circuit of the flyback transformer type.

The strobe-charging circuit shown in FIG. 9, which is a circuit that charges a main capacitor C1 for supplying power to a strobe-light-flashing unit, includes a direct-current power supply 51, a fuse element 52, a step-up transformer 53, a switching element Q1, a feedback capacitor C2, a rectifier diode D1, and the main capacitor C1. The strobe-charging circuit also includes a charging-control unit 61, an oscillation-control unit 62, and a full-charge-detection unit 63, which have functions of controlling the strobe-charging circuit.

The step-up transformer 53 is a flyback transformer that steps up a flyback pulse, which is generated in a primary coil, and that outputs another flyback pulse to a secondary coil. The primary coil is connected in series with the direct-current power supply 51, the fuse element 52, and the switching element Q1. The feedback capacitor C2 is provided between the fuse element 52 and the step-up transformer 53 so as to be connected in parallel to the direct-current power supply 51. A switching group is configured to have the feedback capacitor C2, the primary coil of the step-up transformer 53, and the switching element Q1.

The switching element Q1 is turned on/off on the basis of a switching-control signal from the oscillation-control unit 62. When the switching element Q1 is set to be in a conducting state, a current flows thorough the primary coil of the step-up transformer 53. Then, when the switching element Q1 is set to be in an interrupting state, a counter-electromotive force is generated in the secondary coil of the step-up transformer 53. Accordingly, by continuously turning on/off the switching element Q1, a flyback pulse is generated in the secondarily coil of the step-up transformer 53.

The rectifier diode D1 rectifies the flyback pulse that is generated in the secondary coil of the step-up transformer 53, and supplies a rectified flyback pulse to the main capacitor C1. The main capacitor C1 is charged using the flyback pulse supplied thereto. A charging voltage of the main capacitor C1 is supplied through a power-supply terminal 54 to the strobe-light-flashing unit (not shown in FIG. 9) serving as a load.

The charging-control unit 61 is a processing unit that performs overall control on the strobe-charging circuit. After a strobe-light-flashing operation is performed in the strobe-light-flashing unit, the charging-control unit 61 provides an instruction for starting an oscillation of the switching-control signal to the oscillation-control unit 62. When the full-charge-detection unit 63 detects a fully charged state of the main capacitor C1, the charging-control unit 61 stops an oscillation operation of the oscillation-control unit 62. The full-charge-detection unit 63 determines whether or not the main capacitor C1 is in the fully charged state, for example, by detecting a voltage across the terminals of the main capacitor C1.

In an example of such a strobe-charging circuit of a separately excited oscillation type, when a charging voltage of a main capacitor reaches a predetermined voltage higher than a light-flashing voltage, an oscillation-control unit is reset to stop a charging operation (for example, see paragraphs [0037] to [0042] and FIG. 1 in Japanese Unexamined Patent Application Publication No. 2000-275706). In another example, a value of a current flowing through a primary coil of an oscillation transformer, or a value of a voltage generated by the current, is compared with a value of a normal-operating current, or voltage, and a charging voltage of a main capacitor is compared with a value of a charging voltage in a normal operation, respectively. Then, as an occasional result of the comparison, a series circuit in which a power supply and a fuse are connected in series is shorted to ground by a switching element, thereby blowing the fuse, so that a supply of power is interrupted in the circuit (for example, see paragraphs [0008] to [0012] and FIG. 4 in Japanese Unexamined Patent Application Publication No. 2007-48702).

SUMMARY OF THE INVENTION

However, in the above-described charging circuit of the flyback transformer type, a power-supply voltage, which is output from the direct-current power supply 51, is supplied through the fuse element 52 directly to the primary coil of the step-up transformer 53. The switching element Q1 has a function of passing and limiting a current supplied from the direct-current power supply 51 to the step-up transformer 53. Because a high voltage of the flyback pulse is applied directly to the switching element Q1, the switching element Q1 is configured to have a high-voltage-resistant element manufactured in a high-voltage-resistant process.

However, for example, when an abnormal voltage resulting from a failure or the like in a peripheral circuit is applied to the switching element Q1 or when the switching element Q1 in which a high-voltage-resistant property is diminished performs a switching operation, the switching element Q1 can be broken to become a condition short-circuited between the drain and source terminals thereof. In this case, it is difficult to limit a supply of power from the direct-current power supply 51 to the step-up transformer 53. As a result, an abnormal current continues flowing through the step-up transformer 53 and the short-circuited switching element Q1.

For example, in a case where the switching element Q1 is broken and a short circuit occurs in the switching element Q1, when the resistance of the switching element Q1 including the short circuit is sufficiently large, the flowing abnormal current becomes small. Accordingly, heat generated by the switching element Q1 does not become particularly large. In contrast, when the resistance of the switching element Q1 including the short circuit is sufficiently small, the fuse element 52 blows, whereby the supply of power to the switching element Q1 is stopped.

However, when the resistance of the switching element Q1 including the short circuit is the middle value between the sufficiently large resistance and the sufficiently small resistance, a current that is not so large as to cause blowing of the fuse element 52 but as large as to allow the switching element Q1 to generate heat may flow. In such a case, because the supply of power to the switching element Q1 is not stopped, the amount of heat generated by switching element Q1 becomes further large. Additionally, in a case where the switching element Q1 is formed of a semiconductor, when the amount of heat generated by the switching element Q1 is increased to exceed a certain junction temperature of the switching element Q1, the resistance is sharply decreased. As a result, a further large current may flow.

Furthermore, generally, as a safeguard against an abnormal current, the fuse element 52 is furnished. However, since recently a request for reducing a charging time has been increased, it is necessary to increase a rated current of the fuse element 52 as much as possible so that a current can be increased in normal use. For this reason, it has been difficult to deal with a matter that an abnormal current not so large as to cause blowing of the fuse element 52 flows. Furthermore, there was a problem that even when a rated current of the fuse element 52 capable of dealing with such a matter can be calculated, the fuse element 52 with such a rated current may not be available.

In view of the above-mentioned subject, it is desirable to provide an imaging apparatus including a strobe device having a charging circuit with safety improved for a case where an abnormal current flows through a switching element, a strobe device, or a charging-control method.

According to an embodiment of the present invention, there is provided an imaging apparatus including a strobe device having a charging circuit of a separately excited oscillation type. The imaging apparatus includes the following elements: a main capacitor in which charge is accumulated to supply power to a strobe-light-flashing unit; a step-up transformer including at least primary and secondary coils; a switching element that performs a switching operation on the basis of a switching control signal to control a flowing or a non-flowing state of a current supplied to the primary coil of the step-up transformer; a rectifier diode that rectifies a flyback pulse generated in the secondary coil of the step-up transformer on the basis of the switching operation of the switching element to supply a charging voltage to the main capacitor; a power-supply-interrupting circuit that is provided between, the step-up transformer and the switching element, and a power supply and that selectively interrupts power supplied from the power supply; a full-charge detection unit that detects whether the main capacitor reaches a fully charged state; and a power-supply-control unit that controls the power-supply-interrupting circuit so as to set the power-supply-interrupting circuit to be in an interrupting state, in a case where the full-charge-detection unit does not detect the fully charged state within a predetermined time after the power-supply-control unit has set the power-supply-interrupting circuit to be in a conducting state and started the switching operation of the switching element.

In such an imaging apparatus, the power-supply-interrupting circuit is set to be in the conducting state to supply the power from the power supply to the primary coil of the step-up transformer and the switching element. The switching element performs the switching operation to generate a flyback pulse in the secondary coil of the step-up transformer. The flayback pulse is rectified by the rectifier diode, and supplied to the main capacitor to charge the main capacitor. Then, when the full-charge-detection unit does not detect the fully charged state of the main capacitor within the predetermined time after the power-supply-control unit has set the power-supply-interrupting circuit to be in the conducting state and started the switching operation of the switching element, the power-supply-control unit controls the power-supply-interrupting circuit so as to set the power-supply-interrupting circuit to be in the interrupting state. As a result, a supply of power to the switching element is interrupted.

In the imaging apparatus according to the embodiment of the present invention, when the full-charge-detection unit does not detect the fully charged state of the main capacitor in the predetermined time after the power-supply-interrupting circuit has been set to be in the conducting state and the switching operation of the switching element has been started, the power-supply-interrupting circuit is set to be in the interrupting state. Thus, when an abnormality occurs in the switching element and a current continues flowing while the main capacitor is being charged, the interrupting state of the power-supply-interrupting circuit can prevent the current from flowing through the switching element, thereby preventing the switching element from generating heat. Therefore, the safety can be ensured.

DESCRIPTION OF THE PREFERRED EMBODIMENTS

Embodiments of the present invention, in which imaging apparatuses capable of recoding captured images as digital data, such as digital still cameras, are provided as application examples, will be described in detail with reference to the accompanying drawings.

Figure 1:
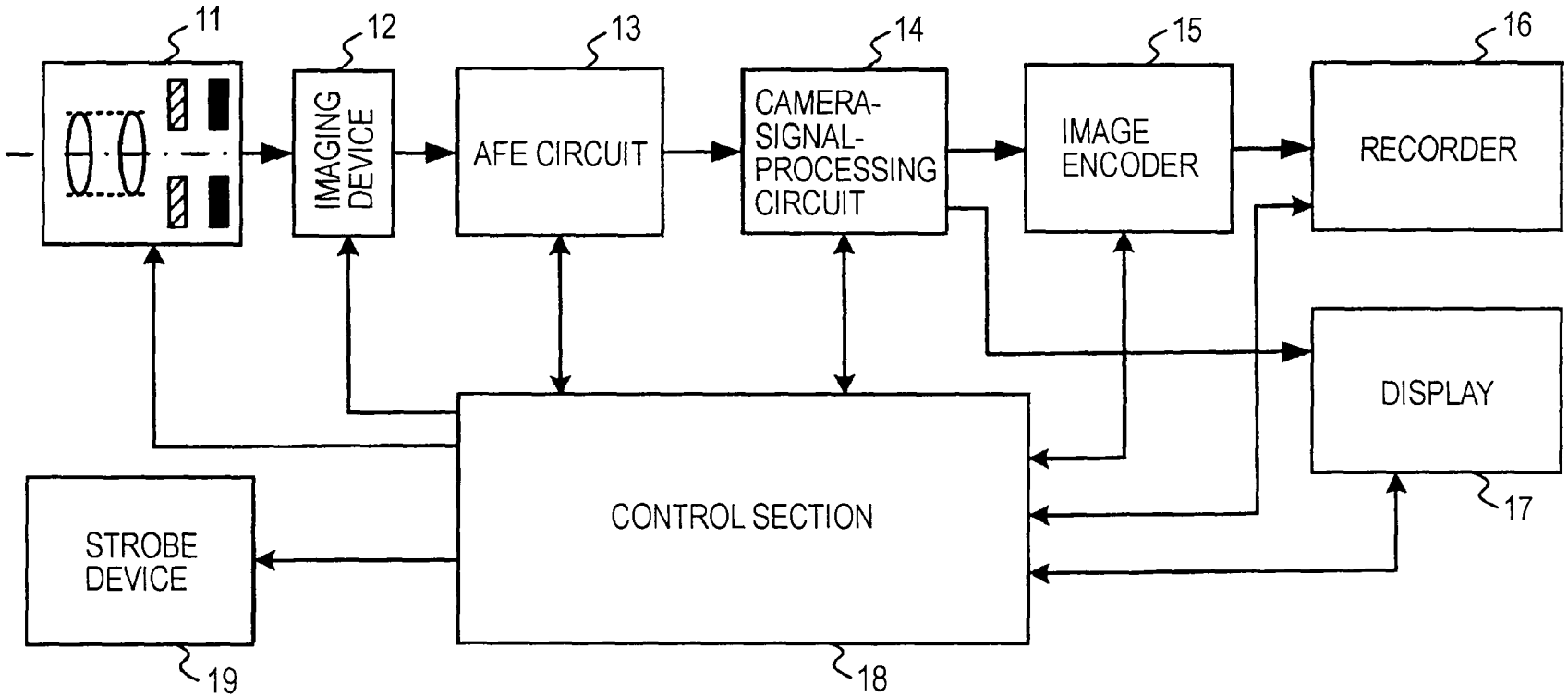
FIG. 1 is a block diagram of a configuration of a principal part of an imaging apparatus according to an embodiment of the present invention.

FIG. 1 is a block diagram of a configuration of a principal part of an imaging apparatus according to an embodiment of the present invention.

The imaging apparatus shown in FIG. 1 includes an optical block 11, an imaging device 12, an analog-front-end (AFE) circuit 13, a camera-signal-processing circuit 14, an image encoder 15, a recorder 16, a display 17, a control section 18, and a strobe device 19.

The optical block 11 includes a lens that gathers light from an object into the imaging device 12, a driving mechanism in which the lens is moved to adjust the focus of the lens and to perform a zooming operation, a shutter mechanism, and an iris mechanism. The lens, the driving mechanism, the shutter mechanism, and the iris mechanism are driven on the basis of control signals from the control section 18. The imaging device 12 is a charge-coupled device (CCD), or a solid-state imaging device of a complementary-metal-oxide semiconductor (CMOS) type or the like, and converts the light, which enters the imaging device 12 from the object through the optical block 11, to an electronic signal.

For an image signal that is output from the imaging device 12, the AFE circuit 13 performs a sample-and-hold operation using a correlated-double-sampling (CDS) process so that the signal/noise (S/N) ratio can be satisfactorily maintained. Additionally, the AFE circuit 13 controls a gain using an auto-gain-control (AGC) process, and performs an analog-to-digital (A/D) conversion to output a digital image signal.

The camera-signal-processing circuit 14 performs various types of detection processes, which are used for an auto-focus (AF) process and an auto-exposure (AE) process, on the basis of the image signal output from the AFE circuit 13. For the image signal, the camera-signal-processing circuit 14 also performs signal processing, such as a white-balance-adjustment process or a color correction process. For the image signal output from the camera-signal-processing circuit 14, the image encoder 15 performs a compression-encoding process using a predetermined image-data format, such as joint-photographic coding-experts-group (JPEG) format. The display 17 is, for example, a liquid-crystal display (LCD), and displays a captured image based on the image signal from the camera-signal-processing circuit 14.

The control section 18 includes, for example, a microcomputer configured to have a central processing unit (CPU), a read-only memory (ROM), a random-access memory (RAM), and so forth, and executes a program stored in the ROM or the like to perform overall control on each portion of the imaging apparatus. The strobe device 19 includes a strobe-light-flashing unit and a charging circuit described below. A strobe-light-flashing operation of the strobe-light-flashing unit and a charging operation of the charging circuit are controlled by the control section 18.

Figure 2:
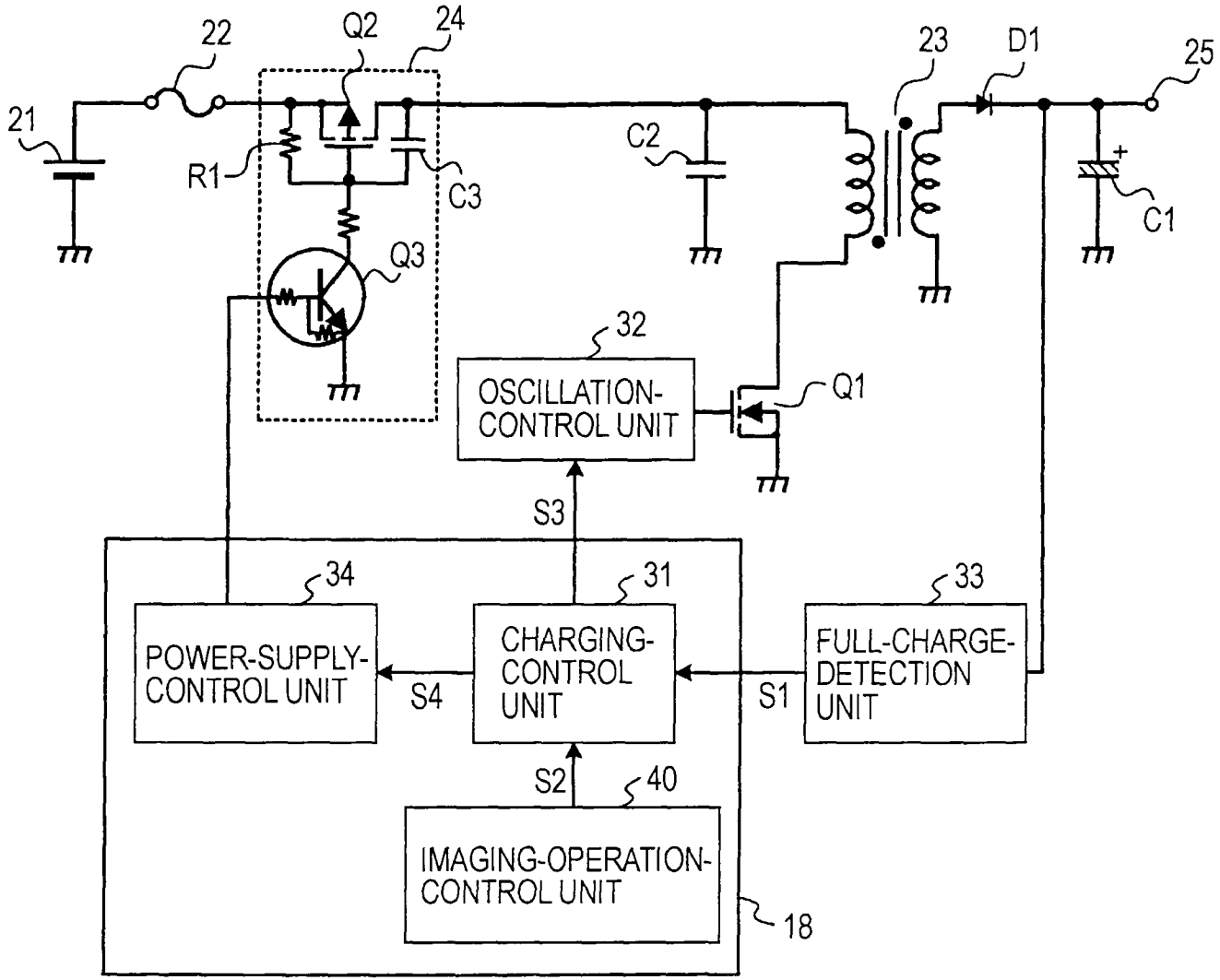
FIG. 2 is a diagram of a configuration of a strobe-charging circuit and control functions thereof.

Next, the charging circuit included in the strobe device 19, and control functions of the charging circuit will be described. FIG. 2 is a diagram of a configuration of a strobe-charging circuit and control functions thereof.

The strobe-charging circuit shown in FIG. 2 is a circuit that charges a main capacitor C1 for supplying power to the strobe-light-flashing unit. The strobe-charging circuit includes a direct-current power supply 21, a fuse element 22, a step-up transformer 23, a switching element Q1, a feedback capacitor C2, a power-supply-interrupting circuit 24, a rectifier diode D1, and the main capacitor C1.

The strobe-charging circuit also includes a charging-control unit 31, an oscillation-control unit 32, a full-charge-detection unit 33, and a power-supply-control unit 34, which have functions of controlling the strobe-charging circuit. In this embodiment, for example, the functions of the charging-control unit 31 and the power-supply-control unit 34 from among the above-mentioned functions are realized by program execution performed by the control section 18. Additionally, the control section 18 includes an imaging-operation-control unit 40 that controls imaging operations including the strobe-light-flashing operation.

For example, a secondary battery can be used as the direct-current power supply 21. A power-supply voltage, which is supplied from the direct-current power supply 21, is supplied through the fuse element 22 and the power-supply-interrupting circuit 24 to a primary coil of the step-up transformer 23. The fuse element 22 is configured to blow when a current equal to or larger than a predetermined value flows.

The step-up transformer 23 is a flyback transformer that steps up a flyback pulse generated in the primary coil, and that outputs another flyback pulse to a secondary coil. The primary coil is connected in series with the direct-current power supply 21, the fuse element 22, the power-supply-interrupting circuit 24, and the switching element Q1. The switching element Q1 is configured to have, for example, an n-channel metal-oxide-semiconductor (MOS) transistor. The gate terminal of the switching element Q1 receives a switching-control signal from the oscillation-control unit 32. The switching element Q1 is turned on/off on the basis of the switching-control signal. The feedback capacitor C2 is provided between the fuse element 22 and the step-up transformer 23 so as to be connected in parallel to the direct-current power supply 21. A switching group is configured to have the feedback capacitor C2, the primary coil of the step-up transformer 23, and the switching element Q1.

The power-supply-interrupting circuit 24 is a circuit that selectively interrupts a current flowing from the direct-current power supply 21 to the step-up transformer 23 and the switching element Q1. In this embodiment, for example, the power-supply-interrupting circuit 24 includes a p-channel MOS transistor Q2, a resistor R1, a capacitor C3, and an n-channel digital transistor Q3. The source terminal of the MOS transistor Q2 is connected to one end of the fuse element 22. The source and gate terminals of the MOS transistor Q2 are connected to each other through the resistor R1. The capacitor C3, which is used for the prevention of an inrush current, is connected between the gate and drain terminals of the MOS transistor Q2. The digital transistor Q3 is turned on/off on the basis of a base-control signal, which is supplied from the power-supply-control unit 34, thereby controlling a conducting/non-conducting state between the gate terminal of the MOS transistor Q2 and the ground.

In the power-supply-interrupting circuit 24, when the digital transistor Q3 is turned on, a gate potential of the MOS transistor Q2 becomes the ground potential. As a result, the MOS transistor Q2 is turned on, and power from the direct-current power supply 21 is supplied to the step-up transformer 23. When the digital transistor Q3 is turned off, the MOS transistor Q2 is also turned off. As a result, a supply of power from the direct-current power supply 21 is interrupted. The configuration of the power-supply-interrupting circuit 24 is not limited to the above-described configuration, and may be implemented with a relay switch.

The rectifier diode D1 rectifies the flyback pulse that is generated in the secondary coil of the step-up transformer 23, and supplies a rectified flyback pulse to the main capacitor C1. The main capacitor C1 is charged using the flyback pulse that is supplied through the rectifier diode D1 to the main capacitor C1. A charging voltage of the main capacitor C1 is supplied through a power-supply terminal 25 to the strobe-light-flashing unit (not shown in FIG. 2) serving as a load.

The charging-control unit 31 is a control unit that performs overall control on the strobe-charging circuit. On the basis of a full-charge-detection signal S1 from the full-charge-detection unit 33 and a strobe-light-flashing signal S2 from the imaging-operation-control unit 40, the charging-control unit 31 controls each function of the switching element Q1 and the power-supply-interrupting circuit 24, thereby controlling a charging function for the main capacitor C1.

The oscillation-control unit 32 controls a switching operation of the switching element Q1 on the basis of an oscillation-start/end-control signal S3 from the charging-control unit 31. In other words, only in a period when the level of the oscillation-start/end-control signal S3 is high, does the oscillation-control unit 32 output the switching-control signal to the gate terminal of the switching element Q1 to allow the switching element Q1 to perform the switching operation.

The full-charge-detection unit 33 detects a voltage across the terminals of the main capacitor C1. When the voltage reaches a predetermined value, the full-charge-detection unit 33 determines that the main capacitor C1 is in a fully charged state, and reports a detection of the fully charged state to the charging-control unit 31.

The power-supply-control unit 34 outputs the base-control signal to the base terminal of the digital transistor Q3 in the power-supply-interrupting circuit 24 on the basis of the power-supply-control signal S4 from the charging-control unit 31. By using the base-control signal, the power-supply-control unit 34 controls the power-supply-interrupting circuit 24 so that the power-supply-interrupting circuit 24 provides/interrupts a supply of power from the direct-current power supply 21 to the step-up transformer 23. In other words, when the level of the power-supply-control signal S4 is high, the power-supply-control unit 34 sets the base-control signal to a high level to provide the supply of power from the direct-current power supply 21 to the step-up transformer 23. When the level of the power-supply-control signal S4 is low, the power-supply-control unit 34 sets the base-control signal to a low level to interrupt the supply of power from the direct-current power supply 21.

The strobe-charging circuit having the above-described configuration has a feature in which the charging-control unit 31 can control the power-supply-interrupting circuit 24, which is included in the strobe-charging circuit, to interrupt the supply of power from the direct-current power supply 21 to the switching element Q1. More specifically, in a case where the full-charge-detection unit 33 does not detect the fully charged state even in a predetermined time after the charging-control unit 31 starts charging the main capacitor C1, the charging-control unit 31 determines that an abnormality occurs in the switching element Q1, and interrupts the supply of power to the switching element Q1. In a case where the occurrence of the abnormality causes a short circuit between the drain and source terminals of the switching element Q1, when an abnormal current, which is not so large as to cause blowing of the fuse element 22, continues flowing, this interruption controlled by charge-control unit 31 can prevent the switching element Q1 from generating heat.

Figure 3:
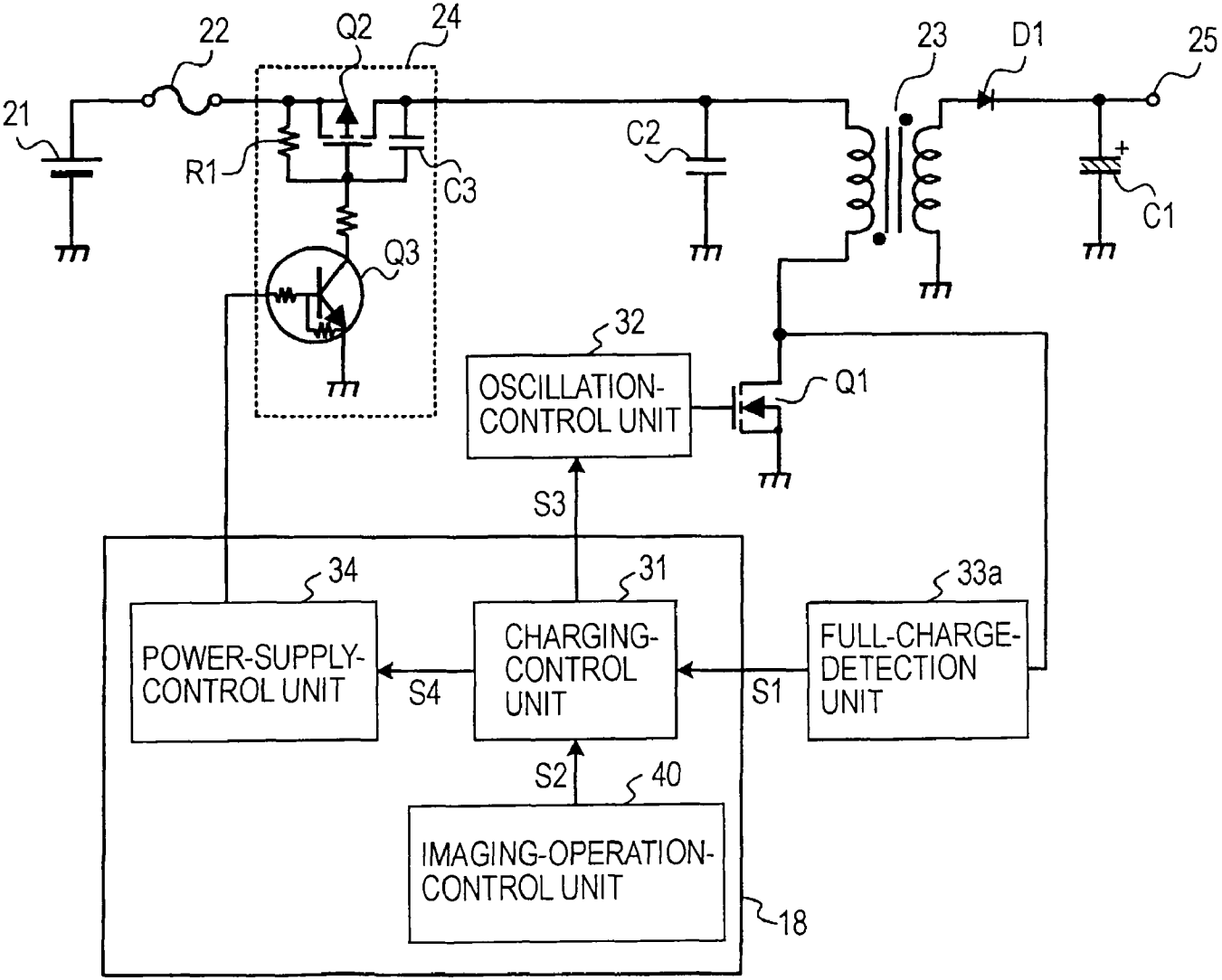
FIG. 3 is a diagram of another configuration of the strobe-charging circuit.

FIG. 3 is a diagram of another configuration of the strobe-charging circuit.

In the above-described configuration shown in FIG. 2, the full-charge-detection unit 33 detects the voltage across the terminals of the main capacitor C1. However, the fully charged state can be detected using another method other than the above-described method. A full-charge-detection unit 33*a* shown in FIG. 3 detects a kickback voltage, which is generated in the switching group including the primary coil of the step-up transformer 23, to detect the fully charged state. A full-charge-detection signal S1 that the full-charge-detection unit 33*a* outputs to the charging-control unit 31 is the same as the full-charge-detection signal S1 of the full-charge-detection unit 33 shown in FIG. 2. Accordingly, the descriptions below will be provided on the basis of the configuration shown in FIG. 2.

First, problems in a case where a short circuit occurs in the switching element Q1 will be described in detail, and then, the detailed operations of the strobe-charging circuit will be described.

In a case where the resistance between the drain and source terminals of the switching element Q1 is decreased due to the occurrence of an abnormality in the switching element Q1, when the amount of a current flowing is sufficiently large, the fuse element 22 blows. As a result, the supply of power to the switching element Q1 is interrupted, thereby immediately preventing the switching element Q1 from generating heat. However, a case can be supposed in which a current that is not so large as to cause blowing of the fuse element 22 but as large as to allow the switching element Q1 to generate heat is flowing in accordance with the resistance of the switching element Q1. Additionally, in a case where the switching element Q1 is formed of a semiconductor, when the amount of heat generated by the switching element Q1 is increased to exceed a certain junction temperature of the switching element Q1, the resistance is sharply decreased. As a result, a further large current may flow.

Using the relationship of input power Pd, which is input to the switching element Q1, a thermal resistance Rθ, and an ambient temperature Ta, an amount Ts of heat generated by the switching element Q1 can be given by equation (1):

$$Ts=Ta+R\theta*Pd \tag{1}$$

As equation (1) shows, the generated heat amount Ts is increased in proportion to the input power Pd. Suppose that a power-supply voltage is a fixed value, namely, VBATT. In a case where the power-supply voltage VBATT is applied to a short-circuit resistance Rds after the switching element Q1 is broken, when a current flowing through the short-circuit resistance Rds is represented by Ids, the relationship given by equation (2) can be obtained:

$$Pd=VBATT*Ids=Rds*Ids^2 \tag{2}$$

Accordingly, using equations (1) and (2), the amount Ts of heat generated by the switching element Q1 can be represented as a temperature increase given by equation (3):

$$Ts=Ta+R\theta*Rds*Ids^2 \tag{3}$$

Figure 4:
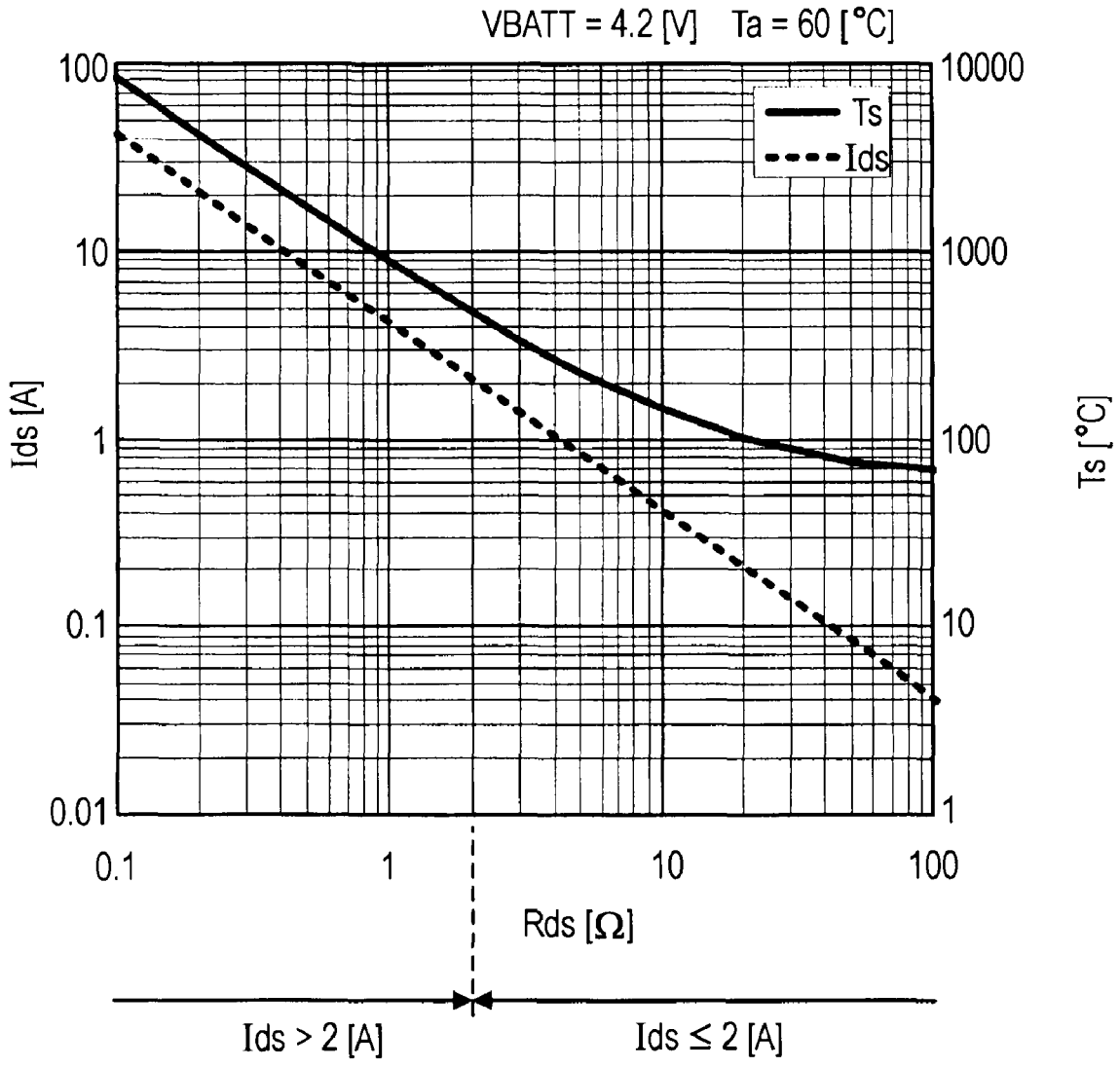
FIG. 4 is an example of a graph showing the relationship between the amount of heat generated by a switching element and other parameters.

FIG. 4 is an example of a graph showing the relationship between the amount of heat generated by a switching element and other parameters.

In FIG. 4, for example, the relationship of the short-circuit resistance Rds to the current Ids and the generated heat amount Ts (a surface temperature of the switching element in this example) is shown in a case where the power-supply voltage VBATT is 4.2 V and the ambient temperature Ta is 60° C. Referring to FIG. 4, for example, even when a current not so large as to cause blowing of the fuse element 22 with a rated current of 1 A (an allowable current of 2 A) is flowing, the surface temperature of the switching element Q1 can become as large as 400° C. The configuration shown in FIG. 2 can deal with such a surface temperature.

In the related art, as a safeguard against an abnormal current, generally, a current fuse is included. The fuse element 22 shown in FIG. 2 is such a current fuse. As one of factors in determining a rated current of the fuse element, an abnormal-current value can be used. Normally, when a specification of the fuse element is determined, the specification includes a margin twice or larger than twice the abnormal-current value that can be expected. Accordingly, it is necessary to set the upper limit of the rated current of the fuse element to be equal to or smaller than half of the minimum abnormal-current value.

Additionally, as other factors in determining the rated current of the fuse element, there are the following two factors: one is the maximum value of a normal-use current flowing in an apparatus in which the fuse element is mounted; and the other is a Joule-integral value of an inrush current flowing in a case where a power supply is connected to an apparatus in which the fuse element is mounted or in a case where a power-supply switch is turned on.

The rated current corresponding to a normal-use current value can be determined hereinafter. The maximum value of a normal-use current is corrected by the following two correction values: one is constant derating, which takes the life of the apparatus in which the fuse element is mounted into consideration; and the other is temperature derating, which depends on an ambient temperature of an ambience in which the fuse element is used. As a result, the lower limit of the rated current can be determined. Accordingly, when the rated current is set, it is necessary for the rated current to include a margin which is sufficient to avoid unexpected blowing of the fuse element in normal use under a state where the life of the apparatus and an ambient-temperature change are taken into consideration.

The rated current against the inrush current can also be determined hereinafter. The waveform of the inrush current, which is measured in the apparatus in which the fuse element is mounted, is integrated to obtain a Joule-integral value $I^2t$. When the rated current is set, it is necessary for the rated current to include a sufficient margin from a characteristic curve showing tolerance against the Joule-integral value $I^2t$ of the fuse element.

However, there is a request that a charging circuit, such as a strobe-charging circuit, have a normal-use current value as large as possible in order to be rapidly charged. For this reason, there is a probability that the lower limit of the rated value, which is determined from the normal-use current value, is larger than the upper limit of the rated current, which is determined from the abnormal-current value. In such a case, it is impossible to set the rated current of the fuse element.

Additionally, because discrete values are set for the rated current of the fuse elements on the market, even when the lower limit of the rated current, which is determined from the normal-use current, is smaller than the upper limit of the rated current, which is determined from the abnormal-current value, i.e., even when a state is provided in which the rated current can be set, there is a probability that it is difficult to obtain a fuse element having the rating current meeting the state.

With the configuration shown in FIG. 2, even when the fuse element 22, which is an existing device having a normal-use current value estimated as a comparatively high value, is used, the above-described heat generation due to an abnormal current can be avoided. Thus, as a purpose, the safety can be ensured.

The above-described technology disclosed in Japanese Unexamined Patent Application Publication No. 2000-275706 and in Japanese Unexamined Patent Application Publication No. 2007-48702 provides a manner in which the switching operation and the supply of power in the circuit are controlled only on the basis of a detected voltage in the secondary or primary coil of the flyback transformer. In this manner, it is difficult to determine whether the switching operation of the switching element Q1 has an abnormality or, in a normal switching operation, a current as large as an abnormal current is flowing. Accordingly, it is difficult to solve the above-described problems.

Next, control operations using the above-described strobe-charging circuit will be specifically described. First, FIG. 5 is a time chart of a first example of a charging-control operation in a normal imaging case.

Figure 5:
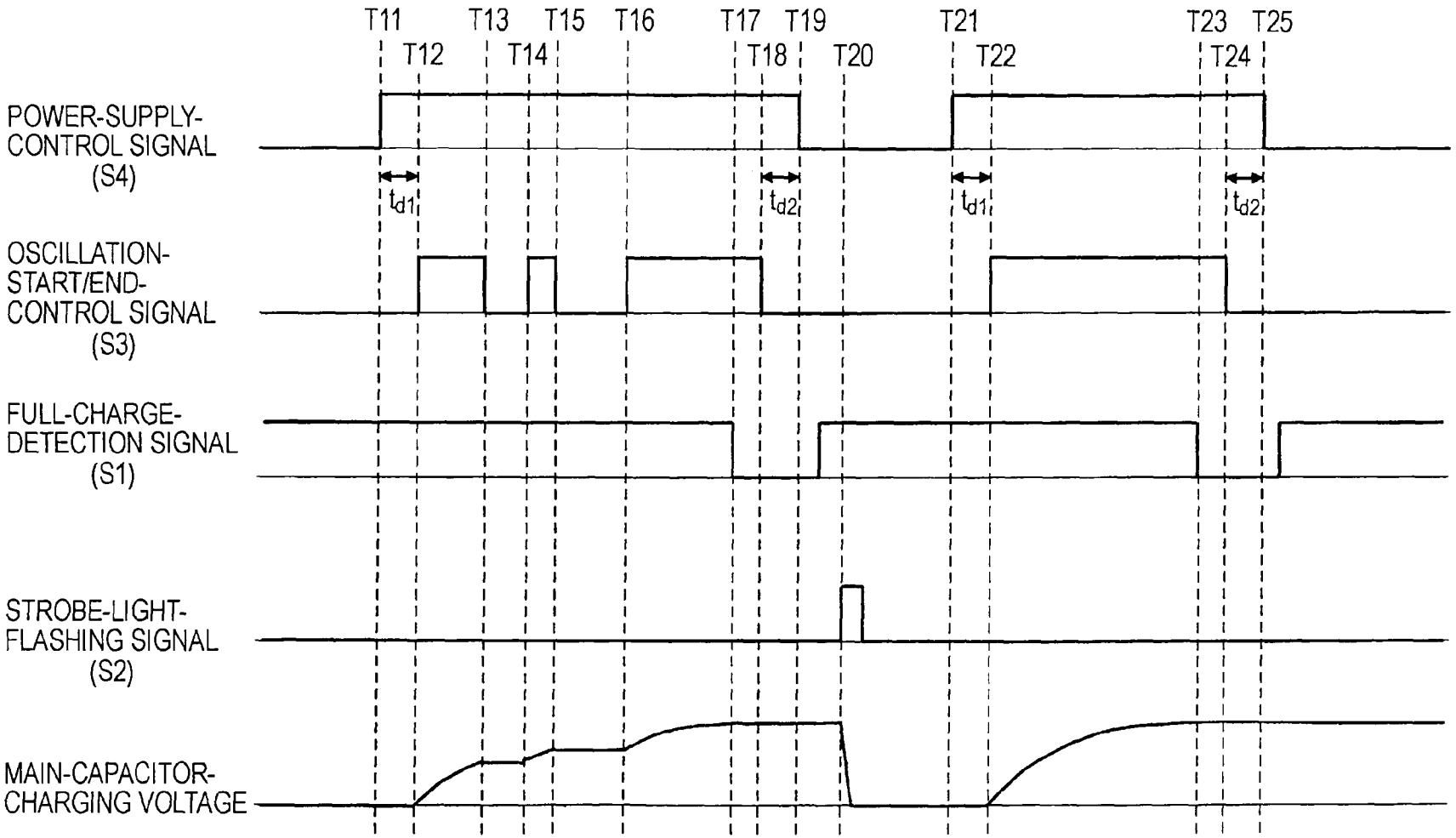
FIG. 5 is a time chart of a first example of a charging-control operation in a normal imaging case.

Referring to FIG. 5, at timing T20, because the main capacitor C1 is in the fully charged state, the imaging-operation-control unit 40 controls the strobe-light-flashing unit so that the strobe-light-flashing unit can perform the strobe-light-flashing operation. In this case, the imaging-operation-control unit 40 outputs the strobe-light-flashing signal S2 to the charging-control unit 31. Immediately or in a predetermined time after the charging-control unit 31 detects the strobe-light-flashing signal S2, the charging-control unit 31 starts charging the main capacitor C1.

Timing T21 shown in FIG. 5 is the timing when the charging-control unit 31 starts charging the main capacitor C1. First, the charging-control unit 31 sets the power-supply-control signal S4, which is output to the power-supply-control unit 34, to the high level to turn on the MOS transistor Q2, thereby starting the supply of power from the direct-current power supply 21 to the step-up transformer 23. Next, at timing T22 when a predetermined time $t_{d1}$ passes from the timing T21, the charging-control unit 31 sets the oscillation-start/end-control signal S3, which is output to the oscillation-control unit 32, to a high level to start the switching operation of the switching element Q1, whereby the charging voltage of the main capacitor C1 is gradually increased.

Next, when, at timing T23, the full-charge-detection unit 33 detects the fully charged state of the main capacitor C1, the full-charge-detection unit 33 sets the full-charge-detection signal S1, which is output to the charging-control unit 31, to a low level. Referring to FIG. 5, an example is shown in which the level of the full-charge-detection signal S1 is low when the fully charged state is detected but the full-charge-detection signal S1 is automatically returned to the high level after a predetermined time. When the charging-control unit 31 detects that the level of the full-charge-detection signal S1 is low, at timing T24 immediately after the detection, the charging-control unit 31 sets the oscillation-start/end-control signal S3 to a low level to stop the switching operation of the switching element Q1. Then, at timing T25 when a predetermined time $t_{d2}$ passes from the timing T24, the charging-control unit 31 sets the power-supply-control signal S4 to the low level to stop the supply of power to the step-up transformer 23.

As described above, in a period including the period in which the switching operation is being performed by setting the oscillation-start/end-control signal S3 to the high level, the level of the power-supply-control signal S4 is high to provide the supply of power to the step-up transformer 23. Accordingly, the charging-control unit 31 controls the oscillation-start/end-control signal S3 and the power-supply-control signal S4 so as to provide or interrupt the supply of power without particularly influencing the charging operation.

Similarly, in a period from timing T11 to timing T19 shown in FIG. 5, power is supplied to the step-up transformer 23 to charge the main capacitor C1. The charging-control unit 31 starts the supply of power at timing T11, and starts the switching operation at timing T12 when the predetermined time $t_{d1}$ passes from the timing T11. Then, after the fully charged state is detected at timing T17, the charging-control unit 31 stops the switching operation at timing T18, and stops the supply of power at timing T19. The above-described operations of the charging-control unit 31 in the period from timing T11 to timing T19 are the same as those of the charging-control unit 31 in a period from timing T21 to timing T25.

However, in the period from timing T11 to timing T19, the charging-control unit 31 sets the oscillation-start/end-control signal S3 to the low level in each of a period from timing T13 to timing T14 and a period from timing T15 to timing T16 to stop the switching operation. In such periods, other operations that consume a comparatively large power are performed in the imaging apparatus. In the periods, a motor may be driven, for example, to move a zoom lens or a focus lens.

The charging-control unit 31 receives, for example, a control signal (not shown in FIG. 5) for enabling/disenabling the charging operation from the imaging-operation-control unit 40. On the basis of this control signal, the charging-control unit 31 performs the switching operation only in a period when the charging operation is enabled.

Figure 6:
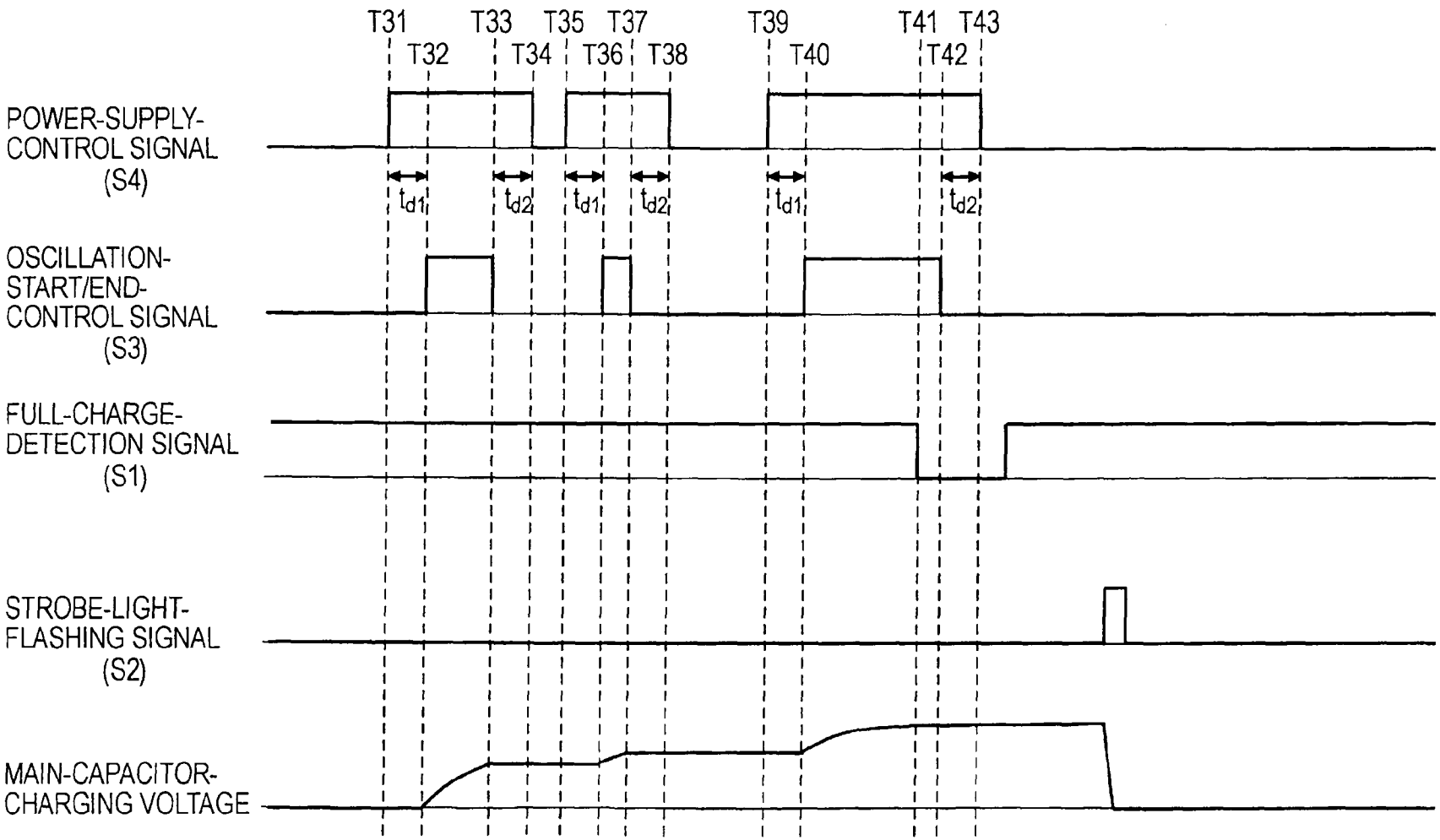
FIG. 6 is a time chart of a second example of the charging-control operation in a normal imaging case.

Next, FIG. 6 is a time chart of a second example of the charging-control operation in a normal imaging case.

Referring to FIG. 6, in a period from timing T31 to timing T43, power is supplied to the step-up transformer 23 to charge the main capacitor C1. As in the case shown in FIG. 5, when the whole charging operation is started, the charging-control unit 31 starts the supply of power to the step-up transformer 23 at timing T31, and then starts the switching operation of the switching element Q1 at timing T32 when the predetermined time $t_{d1}$ passes from the timing T31. When the fully charged state is detected at timing T41, the charging-control unit 31 stops the switching operation at timing T42 immediately after timing T41, and then stops the supply of power at timing T43 when the predetermined time $t_{d2}$ passes from the timing T42.

Additionally, in the period from timing T31 to timing T43, the switching operation is stopped at each of timing T33 and timing T37 in accordance with, for example, the performance of the above-described operation of moving a lens. Even in the period when the charging operation is being performed, when the imaging-operation-control unit 40 does not send a notification that the charging operation can be performed again to the charging-control unit 31 before the predetermined time $t_{d2}$ passes after the switching operation is stopped, the charging-control unit 31 sets the power-supply-control signal S4 to the low level again to interrupt the supply of power (at timing T34 and timing T38). After the interruption of the supply of power, when the charging-control unit 31 receives the notification that the charging operation can be performed again, the charging-control unit 31 starts the supply of power (at timing T35 and timing T39), and then starts the switching operation (at timing T36 and timing T40), as in the case where the charging-control unit 31 operates when the whole charging operation is started.

As described above, the charging-control unit 31 can control the switching operation and the supply of power. Accordingly, for example, in a case where an abnormality occurs in the switching element Q1 due to the performance of an operation that consumes a comparatively large power, such as the operation of moving a lens, when the occurrence of the abnormality causes a short circuit in the switching element Q1, a time in which an abnormal current is flowing through the switching element Q1 can be decreased. As a result, the generated heat amount can be reduced.

Figure 7:
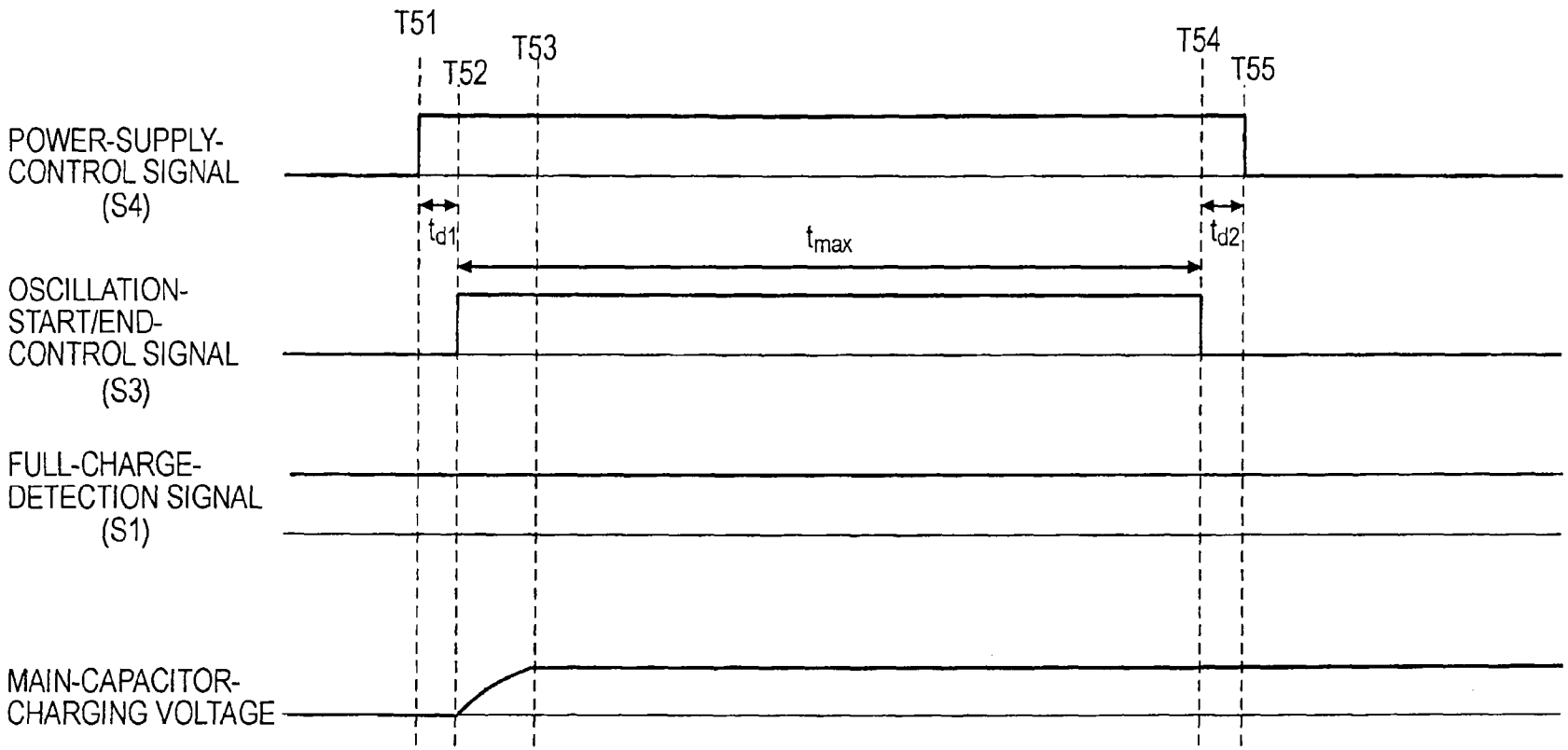
FIG. 7 is a time chart of an example of the charging-control operation when an abnormal current is flowing due to an abnormality occurring in the switching element.

Next, FIG. 7 is a time chart of an example of the charging-control operation when an abnormal current is flowing due to an abnormality occurring in the switching element.

Referring to FIG. 7, at timing T51, the charging-control unit 31 starts the supply of power to the step-up transformer 23. Then, at timing T52 when the predetermined time $t_{d1}$ passes from the timing T51, the charging-control unit 31 starts the switching operation of the switching element Q1 to start charging the main capacitor C1. Suppose that the switching element Q1 is broken and a short circuit occurs in the switching element Q1 at timing T53. In this case, a current not so large as to cause blowing of the fuse element 22 continues flowing. However, because the switching operation is not performed, the main capacitor C1 is not charged. As a result, the fully charged state is not to be detected.

In order to deal with such a case, the charging-control unit 31 includes a counter that counts time. When the charging-control unit 31 starts the switching operation at the timing T52, the charging-control unit 31 starts a counting operation. The charging-control unit 31 monitors whether the fully charged state is detected, on the basis of the full-charge-detection signal S1 until a predetermined maximum waiting time $t_{max}$ is reached.

When the fully charged state is detected before the maximum waiting time $t_{max}$ passes, it is determined that the switching element Q1 does not have a particular abnormality. Accordingly, as shown in FIGS. 5 and 6, the charging-control unit 31 stops the switching operation, and then stops the supply of power to the step-up transformer 23. In contrast, as shown at timing T54 in FIG. 7, when the fully charged state is not detected before the maximum waiting time $t_{max}$ passes, it is determined that an abnormality occurs in the switching element Q1. Accordingly, the charging-control unit 31 stops the switching operation, and also stops the supply of power at timing T55 when the predetermined time $t_{d2}$ passes from the timing T54.

As described above, the charging-control unit 31 can controls the switching operation and the supply of power using the maximum waiting time $t_{max}$. Accordingly, the charging-control unit 31 can estimate that a current not so large as to cause blowing of the fuse element 22 is flowing because the switching element Q1 is broken and a short circuit occurs in the switching element Q1. Thus, the charging-control unit 31 can stop the supply of power to the switching element Q1, thereby preventing the switching element Q1 from generating heat. Additionally, even when the rated current of the fuse element 22 is increased in order to reduce the charging time, the above-described occurrence of the abnormal current can be detected, thereby reliably preventing the switching element Q1 from generating heat. Thus, a strobe-charging circuit having a short charging time and a high safety can be realized. Furthermore, when the rated current of the fuse element 22 is determined, it is not necessary to take the above-described abnormal current into consideration. Thus, a selection range of the fuse element 22 is extended, and an existing fuse such as the fuse element 22 can be used to reduce the manufacturing cost.

The charging-control unit 31 performs the operation of counting time until the maximum waiting time $t_{max}$ is reached at least during a period when power is being supplied to the switching element Q1 from when the switching operation is started (at timing T52). For example, in a case where the counting operation is performed from timing T12 in FIG. 5 as a starting point, the supply of power to the switching element Q1 is continued even in the period when the switching operation is temporarily stopped (the period from timing T13 to timing T14 and the period from timing T15 to timing T16). Accordingly, the charging-control unit 31 continues the counting operation.

In contrast, in a case where the counting operation is performed from timing T32 as a starting point shown in FIG. 6, a period when the switching operation is temporarily stopped (a period from timing T33 to timing T36 and a period from timing T37 to timing T40) includes the period when the supply of power to the switching element Q1 is interrupted (a period from timing T34 to timing T35 and a period from timing T38 to timing T39). In the period when the supply of power is interrupted, the counting operation may be temporarily stopped. Such a temporary stop can prevent the switching element Q1 from generating heat.

Needless to say, as timing when the counting operation is started, timing when the supply of power is started (for example, timing T51 shown in FIG. 7) can be used instead of timing when the switching operation is started (for example, timing T52 shown in FIG. 7).

Figure 8:
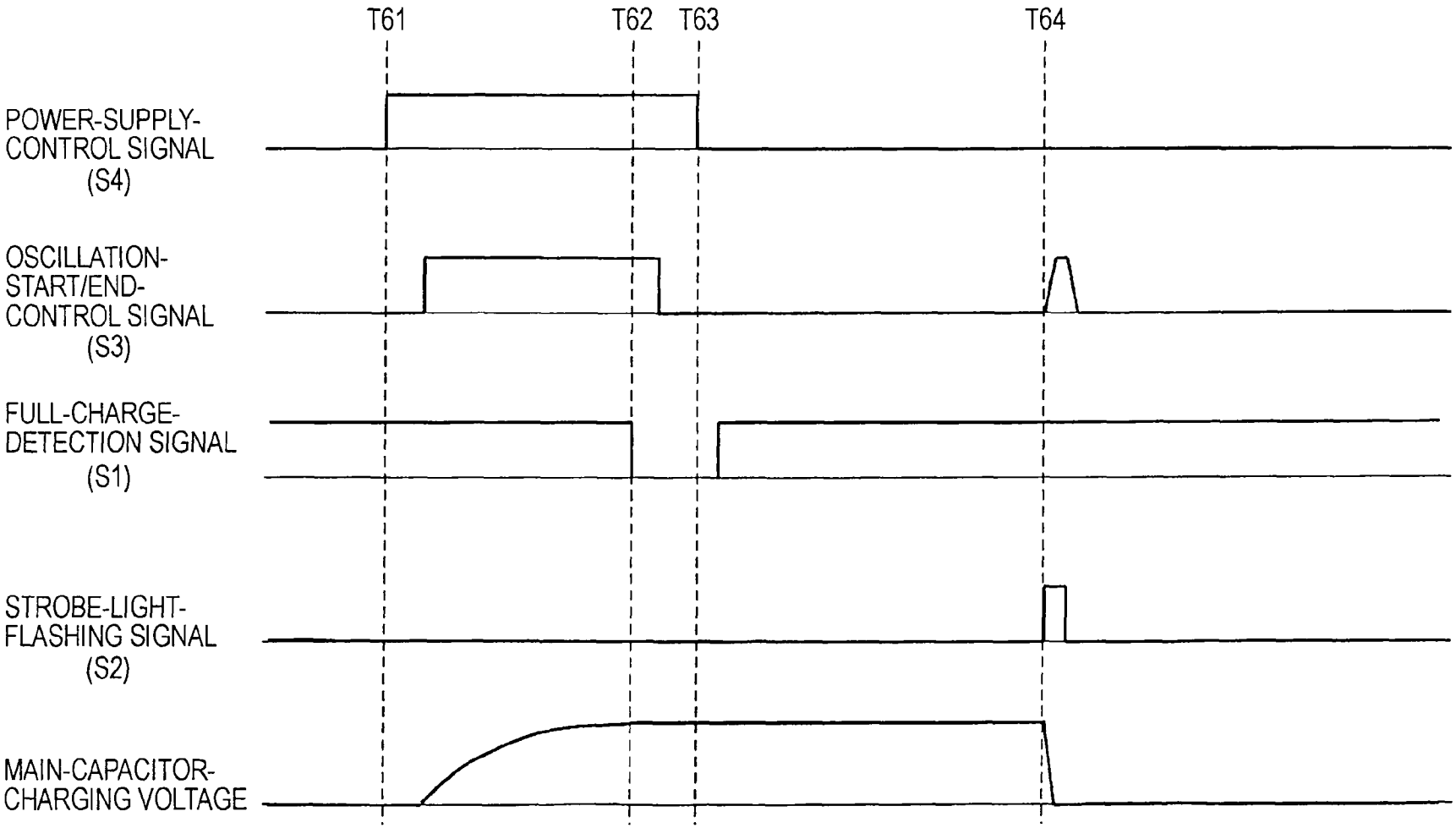
FIG. 8 is a time chart of an example of the charging-control operation when noise is superimposed.
Figure 9:
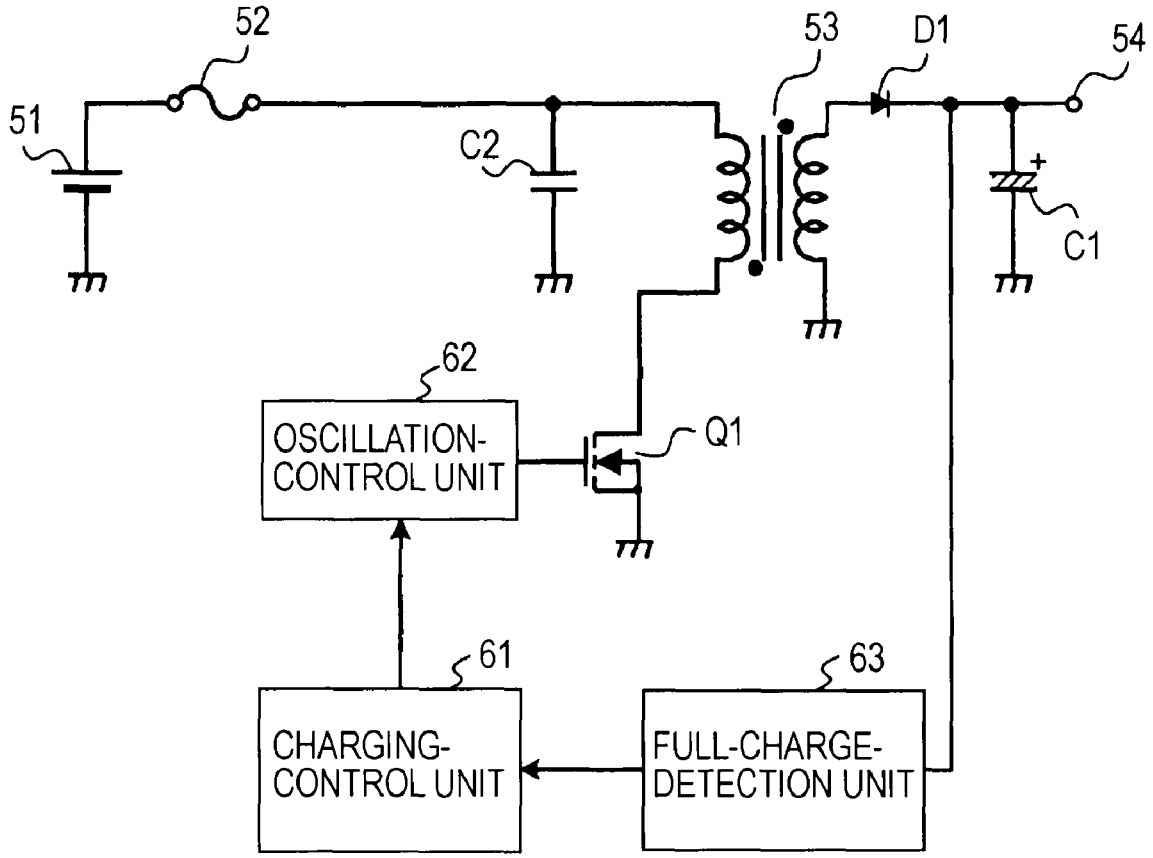
FIG. 9 is a diagram of a strobe-charging circuit of a flyback transformer type as a configuration example.

Next, FIG. 8 is a time chart of an example of the charging-control operation when noise is superimposed.

In the example shown in FIG. 8, the charging operation is started at timing T61. At timing T62, the fully charged state is detected, and at timing T63 immediately after timing T62, the supply of power to the step-up transformer 23 is stopped. Then, at timing T64, the strobe-light-flashing signal S2 is output to perform the strobe-light-flashing operation of the strobe-light-flashing unit.

Suppose that the strobe-light-flashing operation leads to noise superimposed on the oscillation-start/end-control signal S3, which is output from the charging-control unit 31 to the oscillation-control unit 32. In this case, there is probability that the oscillation-control unit 32 starts the switching operation of the switching element Q1 in response to the noise.

However, since the charging-control unit 31 controls the charging operation as described above, the supply of power from the direct-current power supply 21 is stopped when the main capacitor C1 is in the fully charged state. Accordingly, even when the switching operation is accidentally started, no current flows through the switching element Q1. Thus, for example, because a risk that the switching element Q1 is broken by the incorrect switching operation or a risk that the main capacitor C1 reaches an overcharged state can be prevented, the safety in a case where noise occurs can be improved. Additionally, the design flexibility of a path of the oscillation-start/end-control signal S3 in a circuit can be enhanced.

In the above-described embodiments, the direct-current power supply 21 is not limited to a secondary battery. For example, the direct-current power supply 21 may receive a voltage supplied from a commercial-use alternating-current power supply through an alternating current/direct current (AC/DC) converter. The direct-current power supply 21 can use the combination of a secondary battery and a voltage supplied from a commercial-use alternating-current power supply through an AC/DC converter. Furthermore, when a plurality of power supplies are used, the power-supply-interrupting circuit 24 and the fuse element 22 are connected in series between a junction point of power-supply lines from the power supplies and the step-up transformer 23.

In the foregoing embodiments, the strobe device and the imaging apparatus are configured as one unit. However, the strobe device and the imaging apparatus are configured as individual apparatuses. In such a case, for example, the strobe-charging circuit and control functions thereof (realized by the charging-control unit 31, the oscillation-control unit 32, the full-charge-detection unit 33, and the power-supply-control unit 34) may be mounted in the strobe device, and the strobe device may receive a signal related to an imaging operation, such as the strobe-light-flashing signal from the imaging apparatus. Alternatively, a part of the control functions (for example, realized by the charging-control unit 31, the power-supply-control unit 34, and the like) may be included in the imaging apparatus.

Additionally, when a circuit board that the power supply is directly connected to and a circuit board that the strobe-light-flashing unit is mounted on are separated, these circuit boards may be connected to each other through cables and connection terminals. In such a case, for example, the power-supply-interrupting circuit 24 and the fuse element 22 may be mounted on the circuit board that the power supply is directly connected to or on the circuit board that the strobe-light-flashing unit is mounted on.

It should be understood by those skilled in the art that various modifications, combinations, sub-combinations and alterations may occur depending on design requirements and other factors insofar as they are within the scope of the appended claims or the equivalents thereof.

What is claimed is:

1. An imaging apparatus including a strobe device having a charging circuit of a separately excited oscillation type, the imaging apparatus comprising:

a main capacitor in which charge is accumulated to supply power to a strobe-light-flashing unit;

a step-up transformer including at least primary and secondary coils;

a switching element that performs a switching operation on the basis of a switching control signal to control a flowing or a non-flowing state of a current supplied to the primary coil of the step-up transformer;

a rectifier diode that rectifies a flyback pulse generated in the secondary coil of the step-up transformer on the basis of the switching operation of the switching element to supply a charging voltage to the main capacitor;

a power-supply-interrupting circuit that is provided between, the step-up transformer and the switching element, and a power supply and that selectively interrupts power supplied from the power supply;

a full-charge detection unit that detects whether the main capacitor reaches a fully charged state; and a power-supply-control unit that controls the power-supply-interrupting circuit so as to set the power-supply-interrupting circuit to be in an interrupting state, in a case where the full-charge-detection unit does not detect the fully charged state within a predetermined time after the power-supply-control unit has set the power-supply-interrupting circuit to be in a conducting state and started the switching operation of the switching element.

2. The imaging apparatus according to claim 1, further comprising a fuse element that is connected in series between, the step-up transformer and the switching element, and the power supply and that is to blow when an overcurrent occurs.

3. The imaging apparatus according to claim 1, wherein, in a case where the full-charge-detection unit detects the fully charged state within the predetermined time after the power-supply-control unit has set the power-supply-interrupting circuit to be in the conducting state and started the switching operation of the switching element, the power-supply-control unit stops the switching operation of the switching element, sets the power-supply-interrupting circuit to be in the interrupting state, and then controls the power-supply-interrupting circuit so that the power-supply-interrupting circuit can maintain the interrupting state until the power-supply-control unit starts charging the main capacitor after a light-flashing operation of the strobe-light-flashing unit is performed.

4. The imaging apparatus according to claim 1, wherein the power-supply-control unit controls the switching operation of the switching element so as to start the switching operation of the switching element after timing when the power-supply-control unit sets the power-supply-interrupting circuit to be in the conducting state, and then so as to stop the switching operation of the switching element before timing when the power-supply-control unit sets the power-supply-interrupting circuit to be in the interrupting state.

5. The imaging apparatus according to claim 1, wherein the power-supply-control unit counts time until the predetermined time is reached during a period when the power-supply-interrupting circuit is in the conducting state, regardless of a control on the switching operation of the switching element, after timing when the power-supply-control unit sets the power-supply-interrupting circuit to be in the conducting state and starts the switching operation of the switching element.

6. A strobe device including a charging circuit of a separately excited oscillation type, the strobe device comprising:

a main capacitor in which charge is accumulated to supply power to a strobe-light-flashing unit;

a step-up transformer including at least primary and secondary coils;

a switching element that performs a switching operation on the basis of a switching control signal to control a flowing or a non-flowing state of a current supplied to the primary coil of the step-up transformer;

a rectifier diode that rectifies a flyback pulse generated in the secondary coil of the step-up transformer on the basis of the switching operation of the switching element to supply a charging voltage to the main capacitor;

a power-supply-interrupting circuit that is provided between, the step-up transformer and the switching element, and a power supply and that selectively interrupts power supplied from the power supply;

a full-charge detection unit that detects whether the main capacitor reaches a fully charged state; and a power-supply-control unit that controls the power-supply-interrupting circuit so as to set the power-supply-interrupting circuit to be in an interrupting state, in a case where the full-charge-detection unit does not detect the fully charged state within a predetermined time after the power-supply-control unit has set the power-supply-interrupting circuit to be in a conducting state and started the switching operation of the switching element.

7. A charging-control method for a strobe device having a charging circuit of a separately excited oscillation type, the strobe device including a main capacitor in which charge is accumulated to supply power to a strobe-light-flashing unit, a step-up transformer including at least primary and secondary coils, a switching element that performs a switching operation on the basis of a switching control signal to control a flowing or a non-flowing state of a current supplied to the primary coil of the step-up transformer, and a rectifier diode that rectifies a flyback pulse generated in the secondary coil of the step-up transformer on the basis of the switching operation of the switching element to supply a charging voltage to the main capacitor, the charging-control method comprising the steps of:

setting a power-supply-interrupting circuit to be in a conducting state, starting the switching operation of the switching element, and starting charging the main capacitor by a power-supply-control unit, the power-supply-interrupting circuit being provided between, the step-up transformer and the switching element, and the power supply, the power-supply-interrupting circuit selectively interrupting power supplied from the power supply;

detecting whether or not the main capacitor reaches a fully charged state by a full-charge detection unit; and setting the power-supply-interrupting circuit to be in an interrupting state by the power-supply-control unit, in a case where the full-charge-detection unit does not detect the fully charged state within a predetermined time after the power-supply-control unit has started charging the main capacitor.

* * * * *